US007572980B2

(12) United States Patent
Elie et al.

(10) Patent No.: US 7,572,980 B2
(45) Date of Patent: Aug. 11, 2009

(54) COPPER CONDUCTOR WITH ANODIZED ALUMINUM DIELECTRIC LAYER

(75) Inventors: Larry Elie, Ypsilanti, MI (US); John Ginder, Plymouth, MI (US); Clay Maranville, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/627,486

(22) Filed: Jan. 26, 2007

(65) Prior Publication Data

US 2008/0179074 A1 Jul. 31, 2008

(51) Int. Cl.
*H01B 7/00* (2006.01)

(52) U.S. Cl. ..... 174/110 A

(58) Field of Classification Search ..... 174/110 A, 174/126.1

See application file for complete search history.

(56) References Cited

U.S. PATENT DOCUMENTS

| | | | | |
|---|---|---|---|---|
| 723,717 | A * | 3/1903 | Nicholson | 428/652 |
| 2,700,212 | A * | 1/1955 | Flynn et al. | 428/623 |
| 4,390,586 | A | 6/1983 | Lemelson | |
| 5,057,651 | A | 10/1991 | Hope et al. | |
| 5,091,609 | A | 2/1992 | Sawada et al. | |
| 5,300,733 | A | 4/1994 | Uematsu | |
| 5,336,851 | A | 8/1994 | Sawada et al. | |
| 5,372,886 | A | 12/1994 | Inazawa et al. | |
| 6,261,437 | B1 | 7/2001 | Hernnaes et al. | |
| 6,864,613 | B1 | 3/2005 | Graham et al. | |
| 6,951,985 | B1 | 10/2005 | Lemelson | |
| 2002/0053461 | A1 | 5/2002 | Leijon et al. | |
| 2005/0066516 | A1 | 3/2005 | Graham et al. | |

FOREIGN PATENT DOCUMENTS

| | | |
|---|---|---|
| EP | 0410003 A1 | 1/1991 |
| EP | 0410003 B1 | 1/1991 |
| EP | 0729157 B1 | 8/1996 |
| EP | 0813243 B1 | 12/1997 |

* cited by examiner

*Primary Examiner*—Chau N Nguyen
(74) *Attorney, Agent, or Firm*—Julia Voutyras; Brooks Kushman P.C.

(57) ABSTRACT

An electrically insulated conductor for carrying signals or current includes a solid or stranded copper core of various geometries with only a single electrically insulating and thermally conductive layer of anodized aluminum (aluminum oxide). The device is made by forming a uniform thickness thin sheet or foil of aluminum to envelop the copper or copper alloy core. The aluminum has its outer surface partially anodized either before or after forming to the core in an electrolytic process to form a single layer of aluminum oxide.

14 Claims, 3 Drawing Sheets

COPPER CONDUCTOR WITH ANODIZED ALUMINUM DIELECTRIC LAYER

BACKGROUND

1. Technical Field

The present disclosure relates to a copper conductor with an anodized aluminum dielectric layer and a method for making the same.

2. Background Art

The general idea of creating an electrically insulating coating layer on a conducting material is well known. For example, organic wire coatings of polyesters, polyimides, thermoset epoxies, silicone rubbers, and many others have been used in a variety of applications for many years. These types of materials have very good dielectric properties and are able to withstand high voltages. However, they typically are limited to applications with operating/environmental temperatures below about 200-220° C. and are not suitable for high current density or severe environment applications. In addition, polymeric coatings are excellent thermal insulators, which is undesirable for dissipation of ohmic or resistance heating in coil windings. Inorganic wire coverings or coatings, such as glass-fiber sheaths, glass encapsulation, mica, or ceramic materials, may be used to tolerate higher temperatures, but tend to be relatively thick, brittle, and have low radial dimensional control so that they are not amenable to forming processes common in manufacturing electrical machines.

Anodizing electrically conductive materials such as aluminum or copper has been done for nearly a century. Many overhead transmission lines are implemented by aluminum conductors with a thin (about 1 micron) outer layer of aluminum oxide formed by anodization to resist corrosion. However, this layer or skin is too thin to electrically insulate the conductor, so that other measures are required. While suitable for some overhead transmission line applications, the bulk resistance of aluminum wire is generally too high for electromagnetic coil and electrical machine applications.

Copper is generally preferred for conductors used in electromagnetic machines due to its high electrical conductivity. Electroplating aluminum on copper has been attempted, but the aluminum tends to oxidize before it chemically attaches to the copper so that a poor bond is formed and the aluminum layer flakes off of the copper core. Copper can be plated onto an aluminum conductor core, but does not provide the desired electrical characteristics as described above. Copper can also be anodized as disclosed in U.S. Pat. Nos. 5,078,844 and 5,401,382. However, the direct anodization of copper as described in these patents is subject to high strain and cracking as shown by the dielectric strength drop described in U.S. Pat. No. 5,501,382, and the coatings of copper are porous, which makes it difficult or impossible to halt the oxidation process, eventually resulting in an electrical short or breakdown of the wire.

An electrically insulated wire having a copper or copper alloy core conductor with an aluminum oxide layer used to improve adhesion between the conductor core and an outer oxide film insulating layer is disclosed in U.S. Pat. No. 5,091,609. As described in the '609 patent, a thin aluminum or aluminum alloy layer is anodized to form an anodic oxide film having a thickness of only about 10-15 microns thick, which is porous and has a large number of holes passing from its surface toward the base material so that it is generally impossible to obtain an insulating strength which is proportional to the film thickness of the oxide film. This problem is solved using a sol-gel process or acid salt pyrolytic process to fill the holes with an additional oxide insulating layer having a smooth outer surface that decreases gas adsorption and provides electrical insulation proportional to the film thickness.

SUMMARY

An insulated electric conductor for carrying signals or current includes a solid or stranded copper core of various geometries with a single thermally conductive dielectric layer of anodized aluminum (aluminum oxide). The device is made by forming a uniform thickness sheet or foil of aluminum to envelop the solid or stranded copper core. The aluminum has its outer surface partially anodized in an electrolytic process to form a single electrically insulating or dielectric layer of aluminum oxide. The anodization process may be performed either before or after forming of the aluminum sheet to the copper core.

In one embodiment, a method for forming an insulated electric conductor includes enveloping a copper core with a uniform thickness sheet of aluminum having a thickness of between about 3-15 thousandths inch thick and anodizing the outer surface of the aluminum to form a single dielectric layer of aluminum oxide to electrically insulate the copper core. Anodizing the outer layer of the uniform thickness thin sheet or foil of aluminum may be performed before or after mechanically forming the aluminum to the copper core depending upon the particular application and implementation. The anodizing process may be halted using a suitable rinse to remove the electrolytic agent from the aluminum so that the aluminum sheet is only partially anodized. Controlling the thickness of the aluminum sheet and the anodizing process results in a substantially smooth outer dielectric layer without holes or voids with dielectric/insulating properties proportional to the layer thickness. The method may also include annealing the composite conductor after forming to reduce or eliminate any internal stresses in the materials.

The present disclosure includes embodiments having various advantages. For example, embodiments of the present disclosure provide an insulated electric conductor that is mechanically tough, chemically resistant, and suitable for operation at extreme operating and/or environmental temperatures hundreds of degrees higher than conventionally insulated wires. The single dielectric/insulating layer is robust against strain-related defects during mechanical forming and economically viable to produce in large quantities and long continuous lengths. In addition, the mechanical toughness facilitates forming conductors of various cross-sectional geometries and gage-diameters. The insulated electric conductor embodiments of the present disclosure have desirable thermal conductivity to dissipate heat and tolerate higher ohmic heating per square while resisting electrical and environmental degradation so the conductor is suitable for use in electromagnetic coil and electric motor applications, for example, and can be wound into volumetric and thermally efficient coils of short total length and improved efficiency. Use of a uniform thickness sheet of aluminum with proper control of the anodizing process results in formation of a single dielectric layer with a substantially smooth outer surface without holes or voids that can be mechanically formed to a solid or stranded copper core.

The above advantages and other advantages and features will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations.

Figure 1:
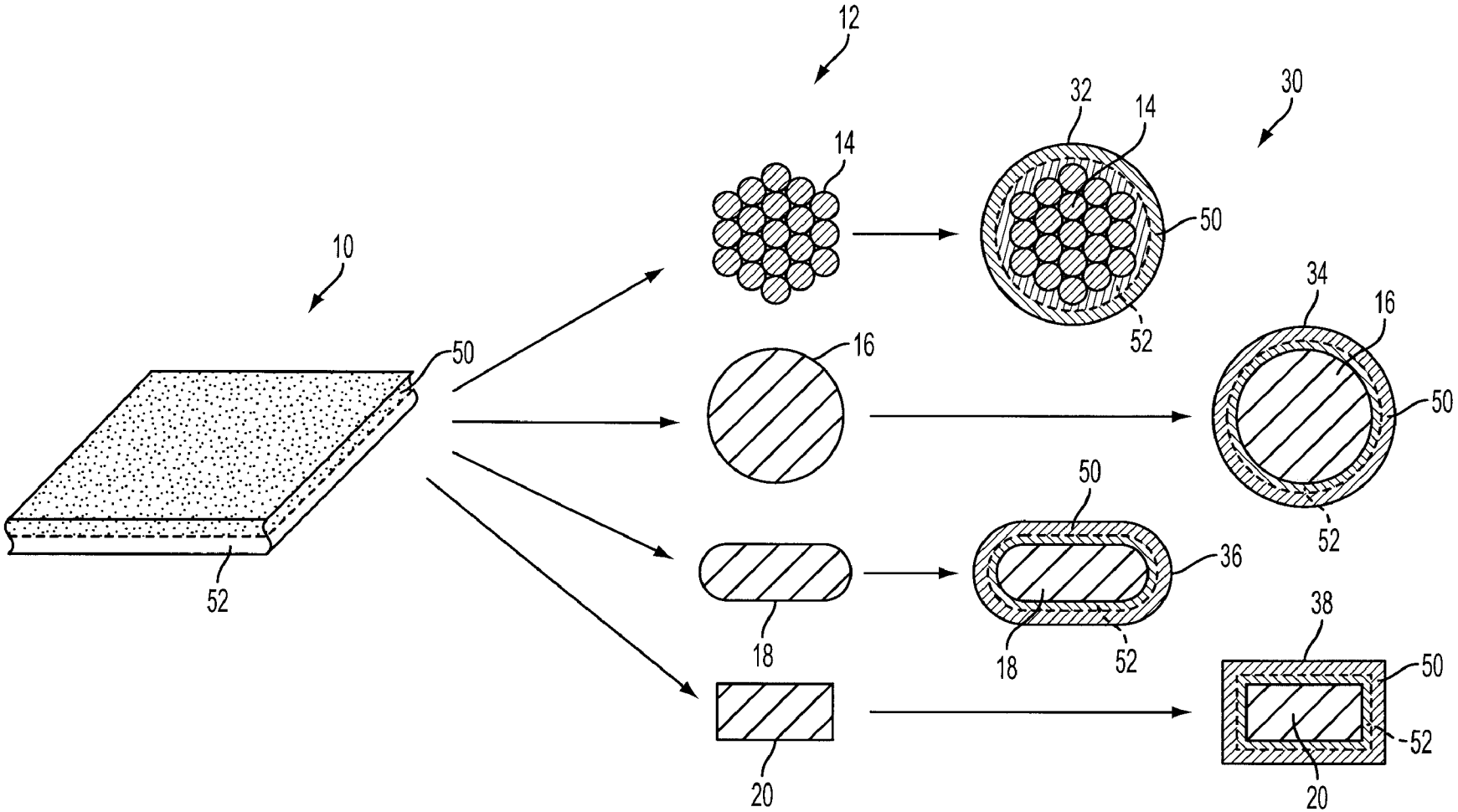
FIG. 1 is a graphical representation of a process for forming and the resulting electric conductors having solid or stranded copper or copper alloy cores of various geometries enveloped by an aluminum sheet that is anodized to form a dielectric layer.

For the representative process/product illustrated in FIG. 1, at least one uniform thickness thin sheet of aluminum 10 is formed to envelop a copper or copper alloy core 12, which may be formed in any of a number of geometries including but not limited to generally circular 16, oval or ribbon-shaped 18, or square/rectangular 20. For example, aluminum sheet 10 may be between about 0.003 inches (76.2 microns) to 0.015 inches (381 microns) thick with a uniformity of +/−0.005 inches (12.7 microns). Other dimensions may be suitable for particular applications consistent with the teachings of the present disclosure. However, the thickness must be selected consistent with the process for forming the aluminum to the core, anodizing the aluminum to form a dielectric layer, and subsequent forming of the composite conductor to avoid failures that may include subsequent separation, flaking, pitting etc. of the dielectric layer, as explained in greater detail herein.

Depending upon the particular application and implementation, aluminum sheet 10 may be partially anodized in an electrolytic process as described in greater detail with reference to FIGS. 2 and 3 to form a dielectric or electrically insulating outer layer 50 of aluminum oxide substantially free of holes or voids. A thin layer 52 of aluminum remains to facilitate adherence to core 12 to form composite insulated conductors 30. Alternatively, thin sheet 10 may be formed to envelop core 12 before anodizing the outer layer.

Copper or copper alloy core 12 may be solid as represented by copper cores 16, 18, or 20, or may be stranded as represented by core 14, which is made of several discrete strands that may be of the same shape and/or size, or may be of complementary shapes/sizes to improve volumetric efficiency. In one embodiment, core 12 is a solid ribbon-shaped core 18 made of oxygen free high conductivity (OFHC) copper with a nominal width of 0.150 inches (3.81 mm) and nominal thickness of 0.010 inches (0.254 mm).

Composite conductors, represented generally by reference numeral 30, are made by forming thin sheet aluminum 10 to envelop a selected copper or copper alloy core 14. Insulated electric conductor 32 is formed by enveloping stranded copper core 14 with uniform thickness thin sheet of aluminum 10 and partially anodizing the outer surface of sheet 10 to form a dielectric layer 50 of aluminum oxide that electrically insulates copper core 14, but is thermally conductive to dissipate heat. A thin layer 52 of electrically conductive aluminum surrounds core 14 and facilitates adhesion or bonding of dielectric layer 50 to core 14. Representative anodization depths of the aluminum oxide layer may range from about 10% to 80% of the thickness of the uniform thickness thin sheet of aluminum after the anodization process is completed.

A similar process may be used to form electrically insulated conductor 34 using uniform thickness thin sheet 10 enveloping a solid copper or copper alloy core 16. Aluminum sheet 10 is partially anodized either before or after forming to copper core 16 to create a dielectric layer 50 of aluminum oxide. A thin layer of aluminum 52 remains to facilitate adhesion of the dielectric layer 52 to the core 16. In one embodiment, a mechanical cold-forming technique was used to form sheet 10 to a ribbon-shaped core 18 to produce a composite conductor 36 that was fully annealed and subsequently anodized in an electrolytic process to form a dielectric layer 50 of about 0.001 inches (0.0254 mm) thick. The particular forming technique may vary depending upon a number of factors that may include the thickness of sheet 10, the geometry of core 12, and/or the particular ultimate application of the composite conductor and selected implementation of the anodizing process, for example. Other techniques or processes used to form sheet 10 to core 14 may include vacuum welding or radio frequency (RF) bonding, for example. After forming, and/or after anodizing, the composite conductor may be annealed to reduce or eliminate stresses within or between the metals to reduce subsequent separation or delamination of sheet 10 from core 14. Depending upon the particular forming process, either or both of the resulting layers of aluminum 52 and aluminum oxide 50 may not have uniform thickness. For example, in forming a composite oval or ribbon-shaped conductor, two thin sheets of aluminum 10 are used to envelop or "sandwich" a corresponding copper core 18 such that the resulting composite conductor includes overlapping portions or seam areas that are about twice the thickness of thin sheet 10. A similar overlap or seam area may result from various other types of forming processes when using a single uniform thickness aluminum sheet 10 to envelop a copper core.

Composite conductor 38 is formed using a similar process to envelop core 20 with a partially anodized thin sheet of aluminum 10 to form a dielectric or electrically insulating (and thermally conductive) layer 50 with a thin layer of aluminum 52 to facilitate bonding of the dielectric layer 50 to the core 20. As those of ordinary skill in the art will appreciate, core geometries that would otherwise have sharp edges or corners, such as rectangular core 20, may be modified to include radiused or rounded corners to reduce internal stresses in core 20 as well as reducing stresses otherwise created during forming of one or more aluminum sheets 10 to envelop core 20.

Figure 2:
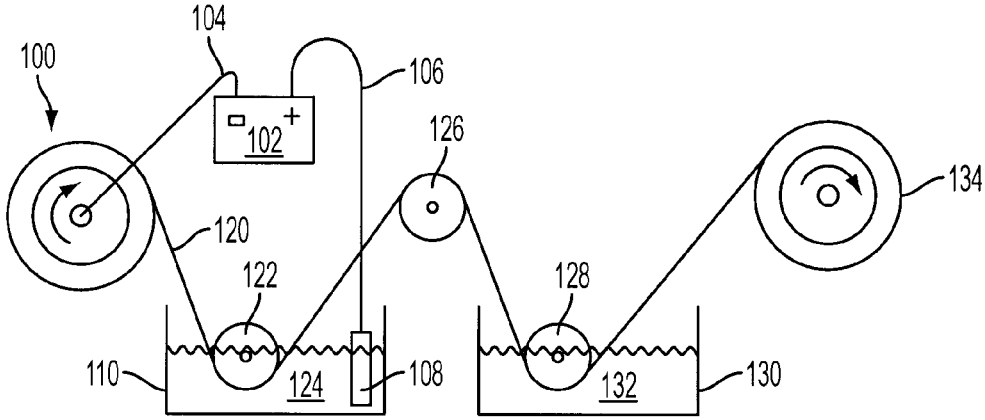
FIG. 2 is a graphical representation of a continuous electrolytic process for forming a dielectric layer on a composite copper/aluminum conductor.

Referring now to FIG. 2, a graphical representation of a continuous electrolytic process for forming a dielectric layer for a composite conductor according to the present disclosure is shown. Supply or feed roll 100 contains a continuous length of wire 120 having a copper or copper alloy core enveloped by a uniform thickness sheet of aluminum as previously described. A power supply 102 has its negative terminal 104 connected to roll 100 and/or wire 120 with a positive terminal 106 connected to an electrode 108, at least a portion of which is disposed within a bath 110 containing an electrolytic agent or solution 124. In one embodiment, a titanium electrode 108 was used with a solution 124 of dilute sulfuric acid with six parts water to one part $H_2SO_4$. A guide roller 122 is at least partially submerged in solution 124 and guides a predetermined length of wire 120 through solution 124 with a voltage applied across terminals 104, 106 to generate a suitable electric current through solution 124 from electrode 108 to wire 120. The electric current facilitates the chemical reaction of the solution 124 with the outer surface of the aluminum to form a dielectric layer of aluminum oxide substantially free of holes or voids. In one embodiment to produce a prototype/development sample, a power supply 102 was used to supply a voltage of nine volts (9V) and electric current of 2.5 amps (2.5 A) with about ten inches (25 cm) of wire 120 exposed to solution 124 with a transit time through solution 124 of about one minute.

Additional guide pulleys 126, 128 may be used to direct wire 120 through an optional rinse 130 having a suitable solution or rinse agent 132, such as deionized water, for example, before being collected by take-up spool 134, which may be driven by an appropriate motor (not-shown). Rinse 130 may be used to remove any residual electrolytic agent 124 from wire 120 to facilitate handling and to further retard or halt the oxidation process. The simplified process illustrated in FIG. 2 may be supplemented with various types of equipment/controls to more precisely control the anodization process and the characteristics and thickness of the resulting dielectric layer. A prototype process as described above produced 1000 continuous meters of a composite ribbon conductor with total cross-sectional dimensions of 0.17 inches (4.318 mm) wide by 0.012 inches (0.3048 mm) thick including a dielectric layer of about 0.001 inches (0.0254 mm) substantially free of holes or voids that was resistive to more than 20 Mohm/square. The wire was wound onto a bobbin where the smallest radius was about 0.8 inches (2 cm). The dielectric strength was then measured as a function of temperature and was found to be equal to the unformed (or unwound) insulated composite ribbon up to a temperature of 350 degrees Celsius as illustrated in FIG. 3.

Figure 3:
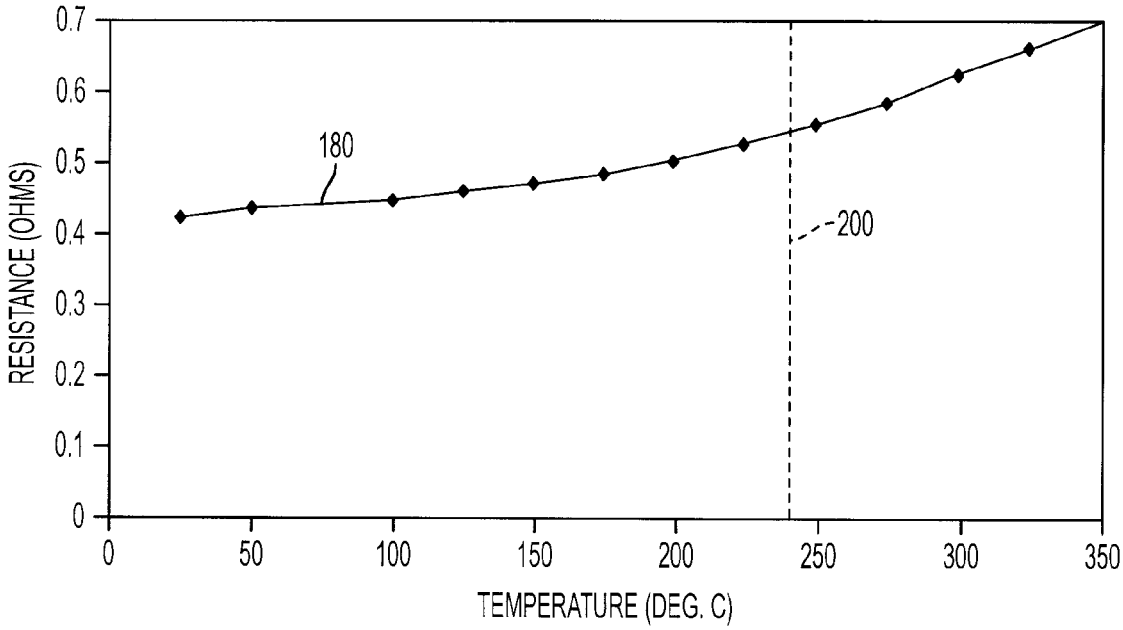
FIG. 3 is a graph illustrating resistance as a function of temperature for a representative insulated electric conductor coil according to one embodiment of the present disclosure.

FIG. 3 is a graph of resistance as a function of temperature for a coil of the prototype insulated composite ribbon conductor previously described. By winding the composite conductor into a multi-layer coil with adjacent turns and subsequent layers in contact with each other, the measured resistance of the coiled conductor is indicative of the integrity of the dielectric layer. As represented by line 180, the dielectric layer integrity was maintained well beyond the limit of conventional insulation materials, represented by dashed line 200. The empirical data verify that the dielectric layer is robust and may be mechanically formed and subjected to extreme operating temperatures while maintaining its electrical insulating characteristics. While the empirical data was collected only up to 350 degrees Celsius, the present inventors expect that the dielectric layer will remain robust when subjected to temperatures approaching the melting point of the aluminum or aluminum alloy, or about 660 degrees Celsius.

Figure 4:
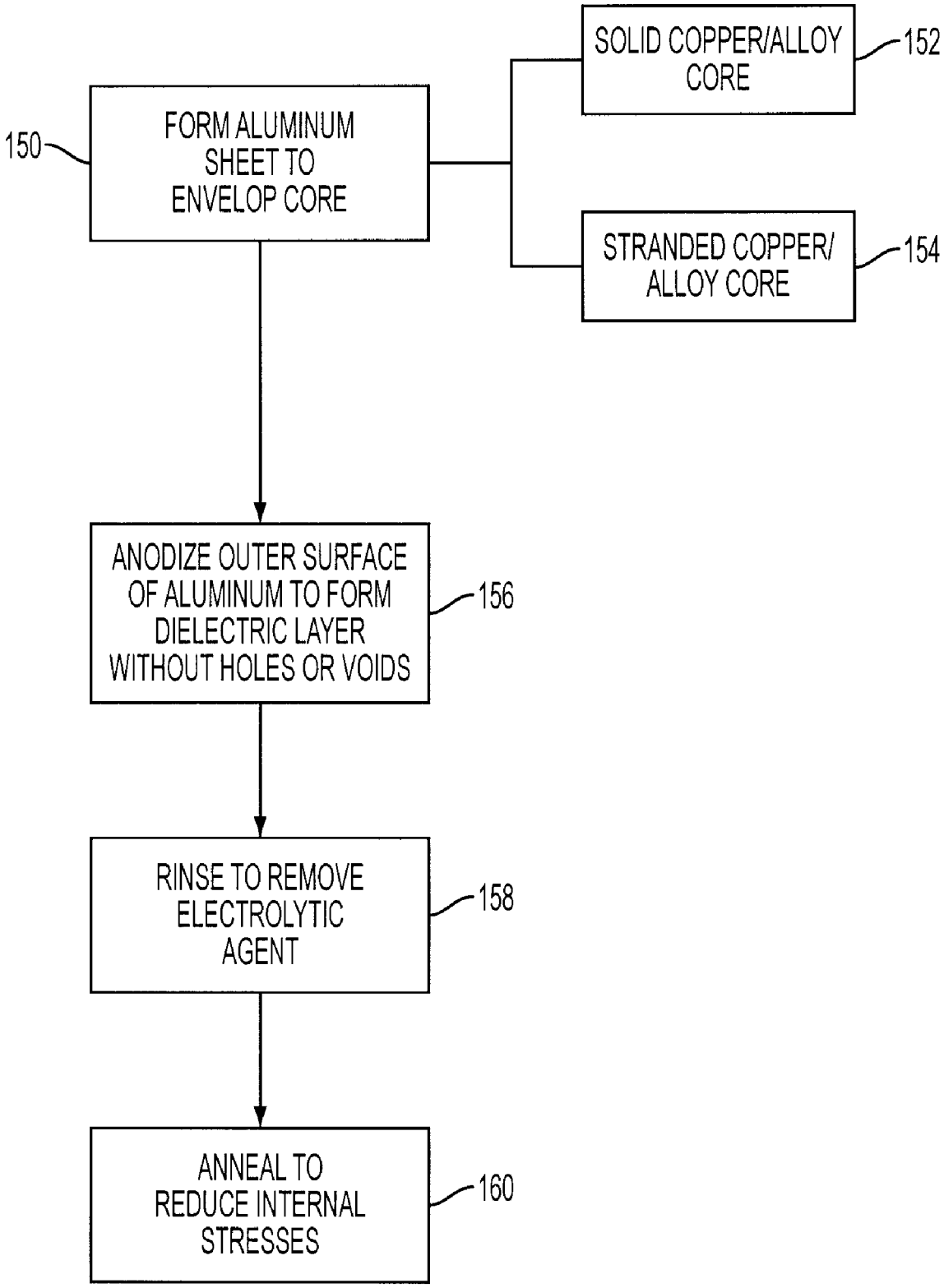
FIG. 4 is a flow chart illustrating a method for making an insulated electric conductor according to embodiments of the present disclosure.

A flow chart illustrating a method for making an electrically insulated conductor according to embodiments of the present disclosure is illustrated in FIG. 4. As those of ordinary skill in the art will appreciate, the process steps represented in FIG. 4 provide a summary or overview of a process for making an electrically insulated composite conductor according to the teachings of the present disclosure. Various steps in the process may be omitted and/or performed in an order different from that illustrated in the Figures while still providing a product or process consistent with the teachings of this disclosure and contemplated by the present inventors. At least one uniform thickness thin sheet of aluminum or aluminum alloy is formed to envelop a copper or copper alloy core as represented by block 150. As previously described, more than one thin sheet may be used to envelop the core depending on the particular core geometry and/or based on the particular application or process implementation. The forming process may include any of a number of mechanical cold-forming techniques, co-extrusion techniques, vacuum welding, RF bonding, and the like. The core may be implemented by a substantially homogenous solid core of copper or copper alloy as represented by block 152, or by individual, discrete strands of copper or copper alloy as represented by block 154. In one embodiment, a solid core of oxygen free high conductivity copper (OFHC) was used to produce an oval or ribbon-shaped composite conductor as previously described.

The outer surface of the aluminum is partially anodized using an electrolytic process as represented by block 156 to form a single homogeneous dielectric layer substantially free of holes and voids. Formation of a only a single dielectric layer requires less processing time than multiple layer processes and reduces the resulting size of the electrically insulated composite conductor to achieve improved volumetric efficiency when used in winding applications. In addition, a single dielectric layer is believed to be less susceptible to delamination or flaking of multiple layers during mechanical forming. Some of the aluminum may be removed or etched away during the anodization process. Preferably, the outer layer is only partially anodized so that a thin layer of aluminum remains in contact with the copper/alloy core. Although not specifically illustrated, the anodizing step 156 may be performed before forming the aluminum sheet to envelop the core if desired.

An optional rinsing step, represented by block 158, may be performed to remove the electrolytic solution or agent from the wire to halt the anodization process and/or to facilitate handling of the wire. Preferably, a thin layer of aluminum remains between the copper/alloy core and dielectric layer to facilitate bonding or adhesion of the dielectric layer.

Block 160 represents an optional step of annealing the composite conductor to reduce or eliminate stresses internal to the core, the aluminum/alloy layer, the dielectric aluminum oxide layer, and/or any residual stresses between layers. The annealing step may alternatively or additionally be performed after the forming step 150 and before anodizing as represented by block 156 if desired.

As such, embodiments of the present disclosure provide an electrically insulated conductor that is mechanically tough, chemically resistant, and suitable for operation at extreme operating and/or environmental temperatures. The single dielectric/insulating layer is robust against strain-related defects during mechanical forming and economically viable to produce in large quantities and long continuous lengths. In addition, the mechanical toughness facilitates forming conductors of various cross-sectional geometries and gage-diameters. The embodiments have desirable thermal conductivity to dissipate heat and tolerate higher ohmic heating per square while resisting electrical and environmental degradation so the conductor is suitable for use in electromagnetic coil and electric motor applications, for example, and can be wound into volumetric and thermally efficient coils having improved efficiency. Use of a uniform thickness sheet of aluminum with proper control of the anodizing process results in formation of a single dielectric layer with a substantially smooth outer surface without holes or voids that can be mechanically formed to a solid or stranded copper core.

While the best mode has been described in detail, those familiar with the art will recognize various alternative designs and embodiments within the scope of the following claims.

What is claimed:

1. An insulated electric conductor comprising:

a copper core;

a uniform thickness thin sheet of aluminum mechanically formed to envelop the copper core; and an outermost dielectric layer of aluminum oxide with no further layer covering the aluminum oxide layer, the aluminum oxide layer formed by anodizing the outer surface of the thin sheet of aluminum.

2. The insulated electric conductor of claim 1 wherein the outer surface of the aluminum is anodized before forming the aluminum sheet to the copper core.

3. The insulated electric conductor of claim 1 wherein the copper core comprises a plurality of discrete copper strands.

4. The insulated electric conductor of claim 1 wherein the dielectric layer of aluminum oxide is formed in an electrolytic process.

5. The insulated electric conductor of claim 1 wherein the dielectric layer of aluminum oxide has a smooth outer surface.

6. The insulated electric conductor of claim 1 wherein the dielectric layer is substantially free of holes and voids.

7. The insulated electric conductor of claim 1 wherein the dielectric layer is formed on only an outer portion of the thin sheet of aluminum by only partially anodizing the outer surface of the thin sheet of aluminum.

8. The insulated electric conductor of claim 1 wherein the dielectric layer extends only part way through the thin sheet of aluminum.

9. The insulated electric conductor of claim 8 wherein the thickness of the dielectric layer is controlled by selectively halting the anodizing process using a rinse to remove an electrolytic agent from the thin sheet of aluminum.

10. The insulated electric conductor of claim 8 wherein the dielectric layer comprises a substantially homogeneous layer of aluminum oxide.

11. The insulated electric conductor of claim 1 wherein the thickness of the aluminum sheet prior to anodization varies less than plus/minus twenty percent.

12. An insulated electric conductor formed by enveloping a copper core with a uniform thickness thin sheet of aluminum and partially anodizing the outer surface of the thin sheet of aluminum to form a single dielectric layer of aluminum oxide that defines the outermost layer of the insulated conductor with no further layer covering the aluminum oxide layer and electrically insulates the copper core.

13. The insulated electric conductor of claim 12 wherein the outer surface is partially anodized to form a dielectric layer of aluminum oxide substantially free of holes or voids extending into the outer surface.

14. The insulated electric conductor of claim 12 wherein the conductor is formed by mechanically forming the thin sheet of aluminum to envelop the copper core.

* * * * *

UNITED STATES PATENT AND TRADEMARK OFFICE
Certificate

Patent No. 7,572,980 B2 Patented: August 11, 2009

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Larry Elie, Ypsilanti, MI (US); John Ginder, Plymouth, MI (US); Clay Maranville, Ypsilanti, MI (US); and Allan Roy Gale, Livonia, MI (US).

Signed and Sealed this Twentieth Day of March 2012.

TIMOTHY THOMPSON
*Supervisory Patent Examiner*
Art Unit 2835
Technology Center 2800